United States Patent [19]

Safrit et al.

[11] Patent Number: 4,492,099

[45] Date of Patent: Jan. 8, 1985

[54] SHEER HOSIERY WITH A RUN-RESISTANT TOE AND METHOD

[75] Inventors: Sam C. Safrit, Pfafftown; Roscoe M. Farrell, Pittsboro; Melvin C. Euliss, Burlington, all of N.C.

[73] Assignee: Kayser-Roth Hosiery, Inc., Burlington, N.C.

[21] Appl. No.: 523,380

[22] Filed: Aug. 15, 1983

[51] Int. Cl.[3] ..... D04B 7/16

[52] U.S. Cl. ..... 66/202

[58] Field of Search ..... 66/178, 169, 169 A, 66/185, 186, 187, 202

[56] References Cited

U.S. PATENT DOCUMENTS

| | | | |
|---|---|---|---|
| 1,996,318 | 4/1935 | Bell | 66/202 |
| 2,004,656 | 6/1935 | Fonville | 66/202 |
| 2,600,851 | 6/1952 | Cooper | 66/202 X |
| 3,157,037 | 11/1964 | Nebel et al. | 66/169 A X |
| 3,293,885 | 12/1966 | Nebel | 66/169 A X |

*Primary Examiner*—Ronald Feldbaum

*Attorney, Agent, or Firm*—Bell, Seltzer, Park & Gibson

[57] ABSTRACT

The run-resistant toe portion is of substantially the same dyed shade and has the same sheer appearance as the adjacent foot portion of the hosiery article. The run-resistant toe portion is knit with every other course being knit of a yarn which is capable of being dyed and the remaining courses are knit of a dye-resistant yarn which is not capable of being dyed. Intervening single courses of the toe portion are knit with alternating tuck and plain stitch loops in adjacent wales while alternating courses are knit with plain stitch loops in every wale and of a smaller stitch loop size to enhance the run-resistant characteristics of the toe portion.

11 Claims, 4 Drawing Figures

SHEER HOSIERY WITH A RUN-RESISTANT TOE AND METHOD

FIELD OF THE INVENTION

This invention relates to a sheer hosiery article, such as pantyhose, with a run-resistant toe portion and to a method of producing the same whereby the toe has a sheer appearance similar to the appearance of the adjacent sheer foot portion of the hosiery article.

BACKGROUND OF THE INVENTION

Many of the runs occurring in sheer hosiery articles begin in the toe portion and are caused by the yarn being broken by the toenails of the wearer. It has long been recognized that sheer hosiery articles can be made run-resistant by knitting various patterns of tuck and plain stitches, either throughout the entire leg portion and/or in selected areas such as bands adjacent the toe and the toe itself. However, this run-resistant type of stitch formation produces an objectionable open mesh appearance to the fabric. The tucks also impart a heavy or dense appearance to the hosiery which is objected to by many women.

One very popular type of run-resistant tuck stitch hosiery fabric is disclosed in U.S. Pat. No. 3,157,037 to Nebel et al. When this type of run-resistant tuck stitch fabric is utilized in either bands or in the entire toe portion of the hosiery article, a sharp contrast is easily observable between the run-resistant tuck stitch fabric and the sheer plain fabric knit in the adjacent portion of the foot. This sharp contrast of fabric appearance is not objectionable to women when the hosiery article is being worn with a shoe having a closed toe because the toe is then concealed. However, when worn with open-toed or sandal-type shoes, the different fabric appearance in the toe and/or run-resistant band adjacent thereto is objectionable.

The heavy or darker appearance of the run-resistant tuck stitch fabric is present because the use of tuck stitches creates a denser or more compact fabric than the knitting of the fabric with plain jersey stitches only. When this type of hosiery article is dyed, the darker or heavier appearance is readily apparent, particularly when the hosiery article is dyed with a darker shade.

SUMMARY OF THE INVENTION

With the foregoing in mind, it is an object of the present invention to provide a circularly knit sheer hosiery article with a run-resistant toe portion which provides the desired run-resistant characteristics to the toe and a method of producing the same whereby the toe maintains a sheer appearance similar to the appearance of the adjacent sheer foot portion of the hosiery article and to thereby eliminate the usual contrast in appearance when the hosiery article is worn with open-toed or sandal-type shoes.

In accordance with the present invention, the run-resistant toe portion is knit with alternating single courses of plain stitch loops in every wale and intervening single courses with alternating tuck and plain stitch loops in adjacent wales. Either the alternating or intervening single courses are knit with a dye-resistant yarn while the remaining courses are knit with a dyeable yarn of the same type as the yarn used in knitting the adjacent sheer foot and leg portions of the hosiery article. Since the yarn in every other course of the run-resistant toe does not receive the dye, the stitch loops in every other course remain substantially clear or translucent so that the run-resistant toe portion does not have the usual heavy or dense appearance of this same run-resistant stitch construction when formed in the usual manner with every course being knit of yarn that is capable of being dyed with the same particular type of dye. Thus, the yarn in only every other course of the run-resistant toe portion is capable of receiving the dye so that the run-resistant toe portion remains of substantially the same dyed shade and sheer appearance as the adjacent sheer foot and leg portions of the hosiery article.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
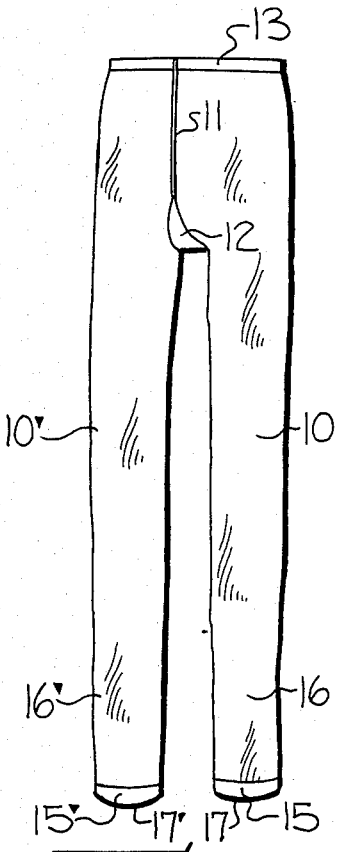
FIG. 1 is a front elevational view of a flattened hosiery article, illustrated as a pair of pantyhose, with the present run-resistant toe portion applied to the lower end of each leg thereof.
Figure 2:
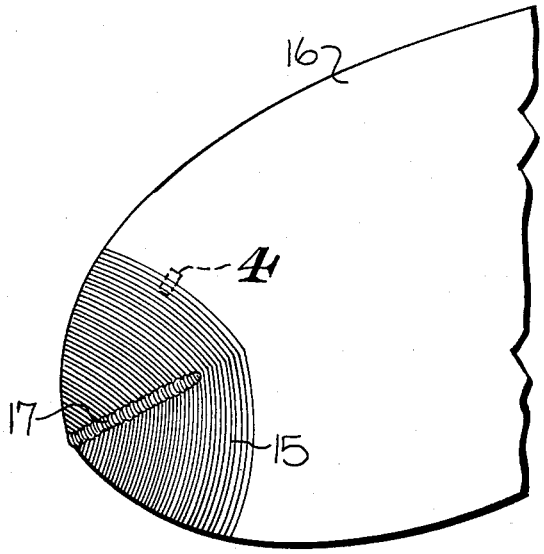
FIG. 2 is a side elevational view of the outer end portion of the foot in flattened condition and illustrating the toe portion being defined by coursewise-extending shade lines.

The run-resistant toe portion is illustrated as being applied to a circularly knit sheer pantyhose. However, it is to be understood that the run-resistant toe portion may be applied to other types of hosiery, such as stockings and the like. The pantyhose of FIG. 1 is formed in the usual manner by initially knitting two seamless tubular blanks, 10, 10'. The upper end portions of the blanks 10, 10' are then slit in a vertical or walewise direction and connected together with a U-shaped seam 11, with, or without a crotch panel 12 inserted therein, to form the panty portion of the pantyhose with an open upper waist opening which may be provided with an elastic welt or band 13.

Figure 3:
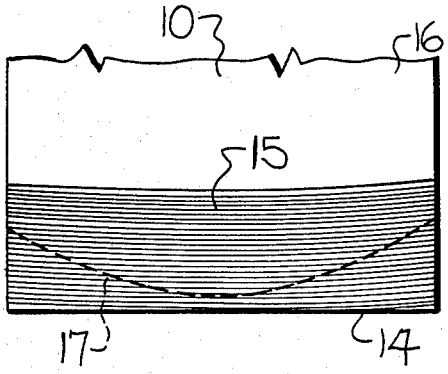
FIG. 3 is a fragmentary elevational view of a flattened portion of one lower end of a hosiery blank used in forming the pantyhose and illustrating in dotted line the manner in which the toe is closed by a curved closure seam.

The leg blanks, 10, 10' are illustrated as being of the "tube" type, that is, they are continuously formed throughout their length with continuous rotation of the needle cylinder and do not contain the usual reciprocated heel and/or toe pockets. It is the usual practice to knit the blanks 10, 10' from the upper to the lower ends and upon completion of the desired length of the blank 10, as illustrated in FIG. 3, the blank is removed from the knitting machine with a straight open bottom, indicated at 14 in FIG. 3. The lower end or toe portion 15 is integrally knit with the adjacent foot portion 16 and is knit with a run-resistant stitch construction, to be presently described.

The leg blanks 10, 10' are usually knit with a fine denier synthetic yarn, usually in the range of 15 to 30 denier, which is capable of being dyed with the usual type of hosiery dye. The successive courses of the leg portions and integral foot portion 16 are knit throughout of plain jersey stitch loops to provide a sheer appearance, as illustrated in wales W-1 through W-5 of courses C-1 and C-2 of FIG. 4. The yarn of the leg and foot portions can be any of the usual types of hosiery yarns, such as textured nylon, indicated at N in courses C-1 and C-2.

Figure 4:
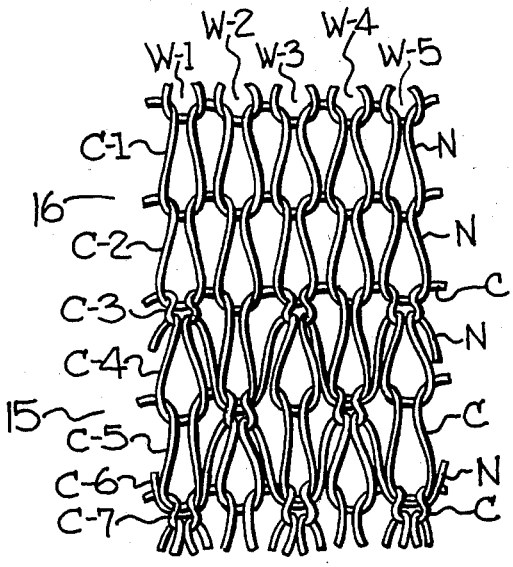
FIG. 4 is a greatly enlarged fragmentary view of the portion of the fabric enclosed by the dotted rectangle 4 in FIG. 2 and illustrating the particular type of tuck and plain stitch construction used in the toe portion, as well as the plain stitch construction used in the adjacent foot portion.

The run-resistant toe portion 15 illustrated in FIG. 4 includes alternating single courses (courses C-3, C-5 and C-7) knit of yarn, indicated at C, which is not capable of being dyed with the same type of dye as the yarn N and forming alternating small and large plain stitch loops in every wale. Intervening single courses (C-4 and C-6) are knit of yarn, indicated at N, which is the same type of yarn as the yarn N forming the leg and foot and which is capable of being dyed with the same type of dye. This yarn N forms alternating tuck and plain stitch loops in adjacent wales. In course C-4 the tucks are formed in wales W-2 and W-4 while the tucks are formed in wales W-1, W-3 and W-5 of course C-6.

Thus, the tucks in one intervening course, such as course C-4, are staggered relative to the tucks in the next intervening course, such as course C-6, so that all wales are protected against runs. To enhance the run-resistant characteristics of the toe portion, the stitch loops in the intervening courses of tuck and plain stitches (courses C-4 and C-6) are knit of substantially the same size as the stitch loops in the courses in the sheer foot portion 16 while the stitch loops in the alternating courses of plain stitch loops (courses C-3, C-5 and C-7) are knit of a smaller size so that every other plain stitch loop substantially draws through the previous stitch loop and forms very small or straight stitch portions extending across the previously formed loops. This general construction of the run-resistant tuck stitch fabric is fully disclosed and described in the aforesaid Nebel et al. U.S. Pat. No. 3,157,037.

The formation of the alternating single courses of plain tight stitch loops and the intervening single courses of tuck and plain stitch loops provides the desired run-resistant characteristics to the toe 15. At the same time, the knitting of every other course of dyeable yarn and the knitting of the remaining courses of dye-resistant yarn retains the desired sheer plain appearance in the toe 15. Although the toe 15 has been described as being knit with the dye-resistant yarn C forming the courses with the plain stitch loops (courses C-3, C-5 and C-7), it has been found that the same sheer plain appearance can be obtained in the toe by knitting the plain stitch courses (courses C-3, C-5 and C-7) with the regular dyeable yarn N while knitting the tuck and plain stitch courses (courses C-4 and C-6) with the dye-resistant yarn C.

As a specific, but nonlimiting example, it has been found that a satisfactory hosiery article can be knit in accordance with the present invention by knitting the sheer leg 10 and foot portion 16 with 20 denier, 7 filament textured nylon yarn, indicated at N in FIG. 4. In the toe 15, alternating single courses of plain stitch loops (courses C-3, C-5 and C-7) are knit of a cationic dyeable yarn C. It is preferred that the cationic dyeable yarn C be of the same size as the dyeable yarn N, that is, 20 denier, 7 filament textured yarn. The intervening single courses (C-4 and C-6) of alternating tuck and plain stitch loops in adjacent wales are knit of the same dyeable yarn N as the leg and foot. After the hosiery article is completed by sewing the toe ends closed with a curved closure seam 17, in the manner illustrated in FIG. 3, the hosiery article is then dyed with a regular hosiery dye. The tuck stitch construction provides the desired run-resistant characteristics to the toe 15 while the cationic dyeable or dye-resistant yarn C is not colored by the regular hosiery dye but remains substantially clear and transparent so that the dye shade of the toe 15 remains substantially the same as the shade of the leg and foot.

There are a number of different types of commercially available hosiery yarns which are capable of being dyed with regular hosiery dyes, as well as a number of different types of hosiery yarns which are not colored or shaded by the regular hosiery dyes. In accordance with the present invention, the dyeable yarn and the dye-resistant or cationic dyeable yarn in the toe portion can be selected from these commercially available yarns. As pointed out above, the sheer appearance of the toe is maintained as long as the dyeable yarn is knit in every other course and the dye-resistant yarn is knit in the remaining courses. Thus, the dyeable yarn can be knit in either the alternating plain stitch courses or in the intervening tuck and plain stitch courses while the dye-resistant yarn is knit in the other courses of the toe.

It is preferred that the yarns knit in the toe be of the same size or denier as the yarn knit in the leg and sheer foot portion. However, it is possible to use a larger or heavier yarn in the toe and still maintain the sheer appearance because one of the toe yarns does not become colored or shaded by the dye.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A circularly knit hosiery article having a sheer foot portion and a run-resistant toe portion, with said toe portion being adapted to have substantially the same dyed shade as the adjacent foot portion, said foot portion being knit of a fine denier synthetic yarn capable of being dyed with a particular type of dye, said toe portion being integrally knit as a continuation of the sheer foot portion and comprising alternating single courses of plain stitch loops in every wale, and intervening single courses of alternating tuck and plain stitch loops in adjacent wales, at least some of said single courses throughout said toe portion being knit of a fine denier synthetic yarn capable of being dyed with said particular type of dye and the remaining courses of said toe portion being knit of a fine denier synthetic dye-resistant yarn which is not capable of being dyed with said particular type of dye, and said single courses of alternating tuck and plain stitch loops providing run-resistant characteristics to said toe portion while said single courses knit of said dye-resistant yarn aid in providing said run-resistant toe portion with substantially the same dyed shade as said sheer foot portion.

2. A hosiery article according to claim 1 wherein 'every other course of said toe portion is knit of said yarn capable of being dyed with said particular type of dye, and the remaining courses of said toe portion are knit of said dye-resistant yarn.

3. A hosiery article according to claim 1 wherein said foot and toe portions are of a "tube" type construction and wherein said alternating and intervening single courses comprise complete circular courses.

4. A hosiery article according to claim 1 wherein the yarns forming said sheer foot portion and said intervening single courses of said run-resistant toe portion are 15 to 30 denier nylon, and wherein the yarns forming said intervening single courses of said run-resistant toe portion are within the range of 15 to 30 denier dacron.

5. A hosiery article according to claim 4 wherein the yarns in both said sheer foot portion and said run-resistant toe portion are each 20 denier.

6. A hosiery article according to claim 1 wherein said alternating single courses are knit of said yarn capable of being dyed with said particular type of dye, and said intervening single courses are knit of said dye-resistant yarn.

7. A hosiery article according to claim 1 wherein the stitch loops of said intervening courses are knit of substantially the same size as the stitch loops in said sheer foot portion, and wherein the stitch loops of said alternating courses are of a smaller size to enhance the run-resistant characteristics of said toe portion.

8. A method of producing a sheer hosiery article which is dyed a particular shade after knitting and including a run-resistant toe portion integrally knit as a continuation of the sheer foot portion of the hosiery article, said sheer hosiery article being characterized by said run-resistant toe portion having a sheer appearance of substantially the same dyed shade as the sheer foot portion, said method comprising the steps of knitting the sheer leg and foot portions of a fine denier synthetic yarn capable of being dyed with a particular type of dye, integrally knitting said run-resistant toe portion of alternating single courses of plain stitch loops in every wale, knitting intervening single courses of alternating tuck and plain stitch loops in adjacent wales, and while knitting either said alternating or said intervening single courses of a fine denier synthetic yarn capable of being dyed with said particular type of dye, and knitting the remaining courses of a fine denier synthetic dye-resistant yarn which is not capable of being dyed with said particular type of dye, and dyeing said hosiery article with said particular type of dye to impart a particular dyed shade to the sheer leg and foot portion and to those courses of said run-resistant toe portion knit of the fine denier synthetic yarn capable of being dyed with said particular type of dye while the single courses of said toe portion knit of said dye-resistant yarn are not dyed but remain substantially clear and transparent to maintain said run-resistant toe portion of substantially the same dyed shade as the sheer leg and foot portions.

9. A method according to claim 8 wherein the courses of the leg, foot and toe portions are knit of yarn within the range of 15 to 30 denier.

10. A method according to claim 8 wherein the alternating single courses of said toe portion are knit of the yarn capable of being dyed and the intervening single courses are knit of the dye-resistant yarn.

11. A method according to claim 8 wherein the stitch loops of the intervening courses of said toe portion are knit of substantially the same size as the stitch loops in the leg and foot and the stitch loops of the alternating courses are knit of a smaller size to enhance the run-resistant characteristics of the toe construction.

* * * * *